US010315290B2

(12) United States Patent
Akashi et al.

(10) Patent No.: US 10,315,290 B2
(45) Date of Patent: Jun. 11, 2019

(54) POLISHING BRUSH

(71) Applicants: TAIMEI CHEMICALS CO., LTD., Nagano (JP); XEBEC TECHNOLOGY CO., LTD., Tokyo (JP)

(72) Inventors: Mitsuhisa Akashi, Nagano (JP); Norihiko Sumiyoshi, Tokyo (JP)

(73) Assignees: TAIMEI CHEMICALS CO., LTD., Nagano (JP); XEBEC TECHNOLOGY CO., LTD., Tokyo (JP)

( * ) Notice: Subject to any disclaimer, the term of this patent is extended or adjusted under 35 U.S.C. 154(b) by 0 days.

(21) Appl. No.: 15/521,271

(22) PCT Filed: Oct. 27, 2014

(86) PCT No.: PCT/JP2014/078532
§ 371 (c)(1),
(2) Date: Apr. 21, 2017

(87) PCT Pub. No.: WO2016/067347
PCT Pub. Date: May 6, 2016

(65) Prior Publication Data

US 2017/0312888 A1 Nov. 2, 2017

(51) Int. Cl.
*B24D 13/14* (2006.01)
*B24D 13/18* (2006.01)
*B24D 13/16* (2006.01)

(52) U.S. Cl.
CPC ..... *B24D 13/145* (2013.01); *B24D 13/14* (2013.01); *B24D 13/16* (2013.01); *B24D 13/18* (2013.01)

(58) Field of Classification Search
CPC ..... B24D 13/14; B24D 13/145; B24D 13/16; B24D 13/18

(Continued)

(56) References Cited

U.S. PATENT DOCUMENTS 3,696,563 A * 10/1972 Rands ..... B24D 13/10 15/197
3,871,139 A * 3/1975 Rands ..... B24B 39/006 15/104.066

(Continued)

FOREIGN PATENT DOCUMENTS

CN 1615208 A 5/2005
CN 101959648 A 1/2011

(Continued)

OTHER PUBLICATIONS

International Search Report for PCT/JP2014/078532, dated Jan. 6, 2015.

(Continued)

*Primary Examiner* — Eileen P Morgan

(57) ABSTRACT

A polishing brush (1) includes a brush-shaped grindstone (12) holding grinding element bundles (11) of wire-shaped grinding elements (27) in an annular shape and a grinding element displacement-restricting member (13) for restricting displacement of the grinding element bundles (11) outward. The brush-shaped grindstone (12) has a grinding element holder (15) holding the base end portions (upper end portions) of the grinding element bundles (11). The grinding element displacement-restricting member (13) has an annular part (33) surrounding the wire-shaped grinding elements (27) from the outer peripheral side at a position between the tip ends of the wire-shaped grinding elements (27) and the grinding element holder (15) in the direction of the axis of center of rotation (L) and at a distance away from the tip ends of the wire-shaped grinding elements (27) and the grinding element holder (15). Since the portions on the side closer to the grinding element holder (15) of the grinding element bundles (11) held in the grinding element holder (15) are exposed outward, cutting fluid or air supplied from (Continued)

the outer peripheral side of the polishing brush (1) easily reaches the polished portion of a workpiece.

6 Claims, 8 Drawing Sheets

(58) Field of Classification Search
USPC ..... 451/465, 466, 469
See application file for complete search history.

(56) References Cited

U.S. PATENT DOCUMENTS

| | | | | | |
|---|---|---|---|---|---|
| 4,128,971 | A * | 12/1978 | Dunnington | B24D 7/02 175/425 |
| 5,460,883 | A * | 10/1995 | Barber, Jr. | A46D 1/00 428/370 |
| 5,649,943 | A * | 7/1997 | Amoils | A61F 9/013 606/107 |
| 6,142,868 | A * | 11/2000 | Pfanstiehl | A46B 11/001 15/169 |
| 9,610,670 | B2 * | 4/2017 | Lancaster-Larocque | B24B 9/00 |
| 2005/0153642 | A1 | 7/2005 | Matsushita et al. | |
| 2012/0071071 | A1 * | 3/2012 | Boudreau | B24D 3/28 451/466 |
| 2014/0364043 | A1 * | 12/2014 | Lancaster-Larocque | B24B 9/00 451/54 |

FOREIGN PATENT DOCUMENTS

| | | | |
|---|---|---|---|
| CN | 102131619 | A | 7/2011 |
| CN | 102152195 | A | 8/2011 |
| CN | 203665340 | U | 6/2014 |
| JP | S60-091357 | U | 6/1985 |
| JP | H08-229831 | A | 9/1996 |
| JP | H09-225106 | A | 9/1997 |
| JP | 2003-089067 | A | 3/2003 |
| JP | 2008-049446 | A | 3/2008 |
| JP | 2011-152594 | A | 8/2011 |
| JP | 2013-141731 | A | 7/2013 |
| WO | 2004/009293 | A1 | 1/2001 |
| WO | 2004/009293 | A1 | 1/2004 |

OTHER PUBLICATIONS

Written Opinion of the International Searching Authority for PCT/JP2014/078532, dated Jan. 6, 2015.
The State Intellectual Property Office of People's Republic of China,Search Report for Chinese Patent Application No. 201480082962, dated May 29, 2018.
The State Intellectual Property Office of People's Republic of China, Office Action for Chinese Patent Application No. 201480082962, dated Jun. 6, 2018,
Japan Patent Office, Office Action, Office Action for Japanese Patent Application No. 2016-556069, dated Jun. 19, 2018.
Japan Patent Office, Office Action, Office Action for Japanese Patent Application No. 2016-556069, dated Sep. 11, 2018.

* cited by examiner

POLISHING BRUSH

FIELD

The present invention relates to a polishing brush including a plurality of wire-shaped grinding elements extending from a grinding element holder in the direction of the axis of center of rotation.

BACKGROUND

A cup-shaped polishing brush is known in which the base end portions of a plurality of wire-shaped grinding elements arranged annularly are held by a grinding element holder. In such a polishing brush, when the polishing brush is rotated in polishing work, the tip ends of the wire-shaped grinding elements extending in the direction of the axis of center of rotation spread outward due to centrifugal force, and the contact position of the wire-shaped grinding elements on the workpiece becomes unstable. The polishing brush described in Patent Literature 1, therefore, is provided with a grinding element holder and a skirt (tubular member) covering the portions on the polishing holder side of the wire-shaped grinding elements on the outer peripheral side. The skirt prevents the spread of the wire-shaped grinding elements outward during rotation.

CITATION LIST

Patent Literature

Patent Literature 1: Japanese Patent Application Laid-open No. 2003-89067

SUMMARY

Technical Problem

Unfortunately, when the skirt covers the polishing brush and the outer peripheral side of the wire-shaped grinding elements, air or cutting fluid supplied from the outer peripheral side of the polishing brush hardly reaches a portion to be polished in the workpiece. For this reason, the polishing brush having a skirt is provided with a through hole passing through in the direction of the axis of center of rotation at the center of the grinding element holder. During polishing operation, this through hole is used to supply air or cutting fluid to the portion to be polished.

In view of the foregoing, the problem to be solved by the present invention is to provide a polishing brush capable of supplying cutting fluid or air to a portion to be polished in a workpiece from the outer peripheral side while preventing the spread of the wire-shaped grinding elements due to centrifugal force during polishing operation.

Solution to Problem

In order to solve the problem above, the present invention is characterized by including a grinding element holder, a plurality of wire-shaped grinding elements protruding from the grinding element holder in the direction of the axis of center of rotation, and a grinding element displacement-restricting member having an annular part surrounding the wire-shaped grinding elements from the outer peripheral side at a position between the tip ends of the wire-shaped grinding elements and the grinding element holder in the direction of the axis of center of rotation and at a distance away from the tip ends of the wire-shaped grinding elements and the grinding element holder.

According to the present invention, the grinding element displacement-restricting member has an annular part surrounding a plurality of wire-shaped grinding elements from the outer peripheral side, thereby preventing the spread of the wire-shaped grinding elements outward due to centrifugal force during polishing operation. Since the annular part is kept apart from the grinding element holder in the direction of the axis of center of rotation, the wire-shaped grinding elements are partially exposed on the outside between the annular part and the grinding element holder in the direction of the axis of center of rotation. Therefore, when air or cutting fluid is supplied from the outer peripheral side toward the exposed portions of the wire-shaped grinding elements, the air or cutting fluid reaches the polished portion of a workpiece easily compared with when the wire-shaped grinding elements are entirely covered on the polishing holder side.

In the present invention, it is preferable that the grinding element displacement-restricting member include: a shaft extending in the direction of the axis of center of rotation on the inner peripheral side of the annular part; and a connection part connecting the shaft with the annular part; the grinding element holder have a shaft hole passing through in the direction of the axis of center of rotation and be removably fixed to the shaft passing through the shaft hole, and the connection part connect the shaft with a circumferential portion of the annular part. In this configuration, the grinding element holder can be easily fixed to the grinding element displacement-restricting member. The position of the shaft to which the grinding element holder is fixed is changed in the direction of the axis of center of rotation, whereby the amount of protrusion of the wire-shaped grinding element from the annular part can be adjusted in the direction of the axis of center of rotation. In addition, since the coupling part is bridged from the shaft to a circumferential portion of the annular part, the grinding element holder-side portions of the wire-shaped grinding elements are not covered around the entire periphery.

In the present invention, the annular part and the connection part may be integrally formed, and the connection part may be removably attached to the shaft. With this configuration, when the tip ends of the wire-shaped grinding elements spreading outward due to centrifugal force come into contact with the annular part and wear the annular part, the annular part can be replaced with a new one together with the connection part.

In the present invention, the connection part may include an annular part-side connection portion extending continuously from the annular part and a shaft-side connection portion connecting the annular part-side connection portion with the shaft. The annular part-side connection portion and the shaft-side connection portion may be removably connected. With this configuration, for example, when the tip end portions of the wire-shaped grinding elements spreading outward due to centrifugal force come into contact with the annular part and wear the annular part, the annular part-side coupling portion and the annular part can be replaced with new ones.

In the present invention, it is preferable that the grinding element holder include: a first annular part having the shaft hole; a second annular part having an inner diameter size larger than the first annular part and disposed at a distance away from the outer peripheral side of the first annular part; and a holder-side connection part connecting a circumferential portion of the first annular part with a circumferential portion of the second annular part, the wire-shaped grinding elements be held in the second annular part and are disposed annularly around the axis of center of rotation, and when viewed from the direction of the axis of center of rotation, the holder-side connection part coincide with the connection part of the grinding element displacement-restricting member. In this configuration, air or cutting fluid can be supplied in the direction of the axis of center of rotation toward the inner peripheral side of the wire-shaped grinding elements held in the second annular part, through the opening of the grinding element holder formed between the first annular part and the second annular part and off the holder-side coupling portion.

In the present invention, it is preferable that the wire-shaped grinding elements be subdivided and bundled into a plurality of grinding element bundles, and the grinding element bundles be arranged annularly to be kept apart from each other. With this configuration, air or cutting fluid can be supplied to the inner peripheral side of the grinding element bundles held in the second annular part and arranged annularly, through the gap between the adjacent grinding element bundles.

In the present invention, it is preferable that a metal covering member cover the end portions on the tip end side of the wire-shaped grinding elements on the inner peripheral surface of the annular part, and at least the annular part of the grinding element displacement-restricting member be made of resin. When the annular part is made of resin, the weight of the polishing brush can be reduced compared with when the annular part is made of metal. This leads to reduction of power load of the machine tool to which the polishing brush is attached. In addition, when the annular part is made of resin, the production cost for the grinding element displacement-restricting member can be suppressed compared with when the annular part is made of metal. However, when the annular part is made of resin, the annular part may be worn when the tip end portions of the wire-shaped grinding elements spreading outward due to centrifugal force come into contact with the annular part. In this respect, covering the inner peripheral surface of the annular part with the covering member can prevent wear of the annular part.

DESCRIPTION OF EMBODIMENTS

Figure 1:
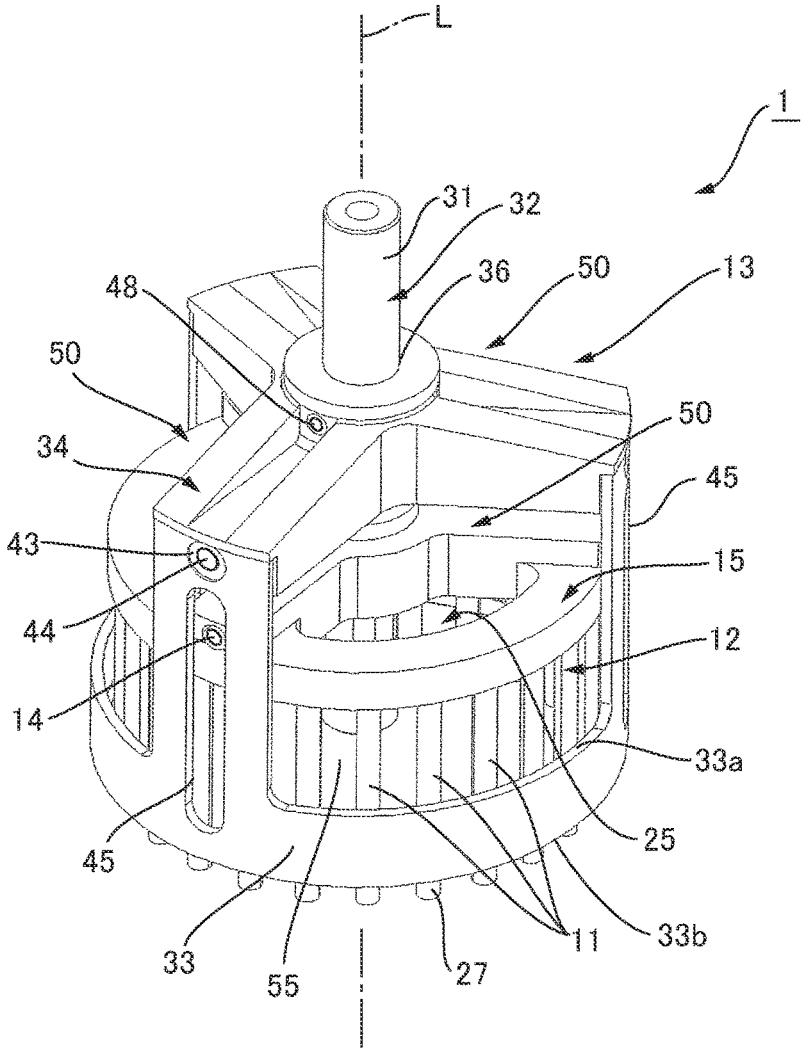
FIG. 1 is a perspective view of a polishing brush according to a first embodiment of the present invention.

Embodiments of the present invention will be described with reference to the drawings. In the following description, it is assumed that the top-bottom in the drawings is the top-bottom of the polishing brush, for the sake of convenience.

First Embodiment

Figure 2:
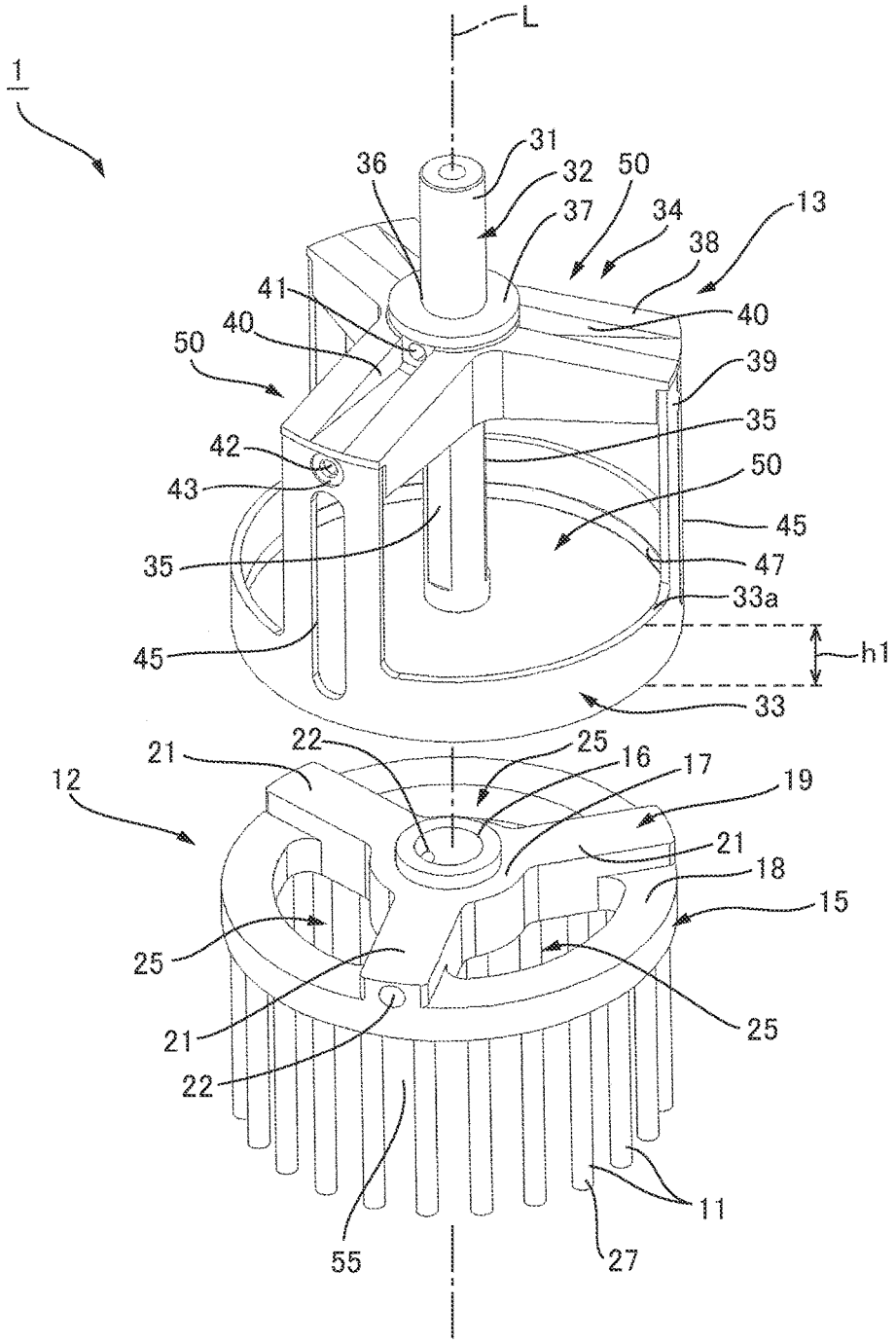
FIG. 2 is an exploded perspective view of the polishing brush in FIG. 1.
Figure 3A:
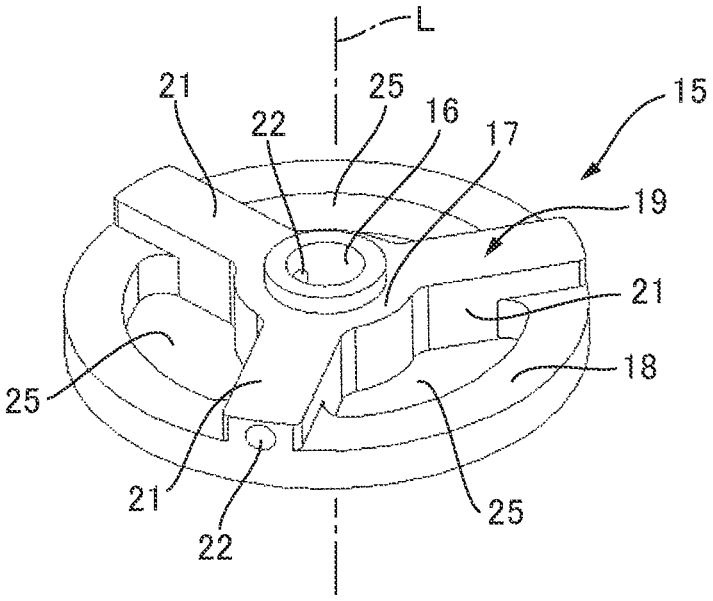
FIG. 3 is a perspective view of a grinding element holder.
Figure 3B:
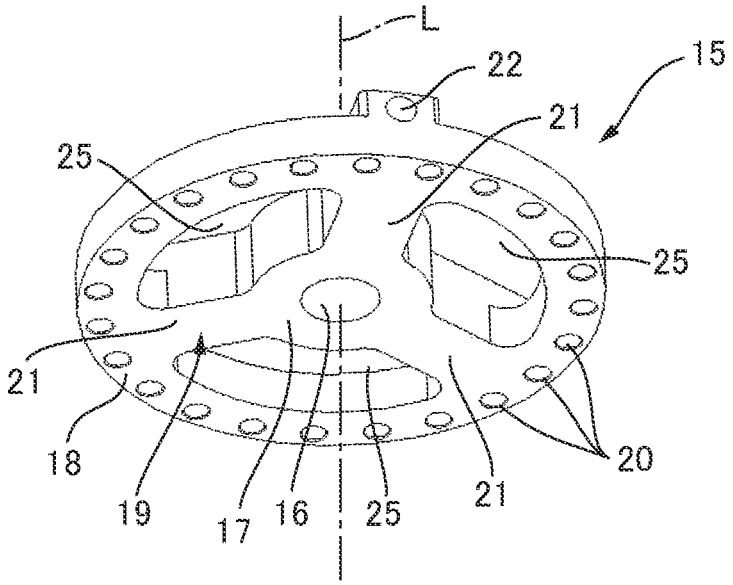

FIG. 1 is a perspective view of a polishing brush according to a first embodiment of the present invention. FIG. 2 is an exploded perspective view of the polishing brush in FIG. 1. FIG. 3(*a*) is a perspective view of a grinding element holder viewed from above, and FIG. 3(*b*) is a perspective view of the grinding element holder viewed from below. As shown in FIG. 1, the polishing brush 1 in the first embodiment includes a brush-shaped grindstone 12 having a plurality of grinding element bundles 11 arranged annularly, and a grinding element displacement-restricting member 13 for restricting displacement of the grinding element bundles 11 outward. The brush-shaped grindstone 12 is removably attached to the grinding element displacement-restricting member 13 with setscrews 14.

(Brush-Shaped Grindstone)

As shown in FIG. 1 and FIG. 2, the brush-shaped grindstone 12 includes a grinding element holder 15 holding the base end portions (upper end portions) of the grinding element bundles 11. Each of the grinding element bundles 11 protrudes downward from the grinding element holder 15 in the direction of the axis of center of rotation L. The grinding element holder 15 is made of resin or metal. In the first embodiment, the grinding element holder 15 is made of ABS resin. As shown in FIG. 3, the grinding element holder 15 includes a first annular part 17 having a holder-side shaft hole 16 at its center, a second annular part 18 disposed concentrically with the first annular part 17 on the outer peripheral side of the first annular part 17, and a holder-side connection part 19 connecting a circumferential portion of the first annular part 17 with a circumferential portion of the second annular part 18. As shown in FIG. 3(*b*), on the lower surface of the second annular part 18, a plurality of holding holes 20 for holding the grinding element bundles 11 are formed annularly at regular angular intervals.

The holder-side connection part 19 includes three holder-side arm portions 21 extending radially. The three holder-side arm portions 21 extend in the radius direction at regular angular intervals to connect the first annular part 17 with the second annular part 18 at three places in the circumferential direction. The grinding element holder 15 therefore has holder-side openings 25. Each of the holder-side openings 25 is arranged between the first annular part 17 and the second annular part 18 and between the adjacent two holder-side arm portions 21. The holder-side arm portions 21 have holder-side through holes 22 extending in the radius direction from the end surface on the outer peripheral side to reach the holder-side shaft hole 16 in the first annular part 17. The inner peripheral surface of each of the holder-side through holes 22 has a screw portion that is female-threaded at least at a portion near the holder-side shaft hole 16.

Each of the grinding element bundles 11 is a bundle of a plurality of wire-shaped grinding elements 27. The wire-shaped grinding element 27 is formed of an assembly of inorganic filaments impregnated and hardened with thermosetting binder resin such as silicone resin, phenol resin, epoxy resin, polyimide resin, polymaleimide resin, unsaturated polyester resin, and urethane resin, or thermoplastic resin such as nylon. In the first embodiment, the inorganic filaments are alumina filaments. The filament assembly is a group of 250 to 3000 alumina filaments with a fiber diameter of 8 to 50 μm. The diameter of the filament assembly is 0.1 mm to 2 mm. The filament assembly may be twisted.

The grinding element bundles 11 have respective base end portions inserted in the holding holes 20 in the grinding element holder 15 and fixed with an adhesive. A plurality of grinding element bundles 11 are thus held annularly in the grinding element holder 15.

(Grinding Element Displacement-Restricting Member)

As shown in FIG. 1, the grinding element displacement-restricting member 13 has a shaft 32 having a shank portion 31 coupled to the head of a machine tool (drive device), an annular part 33 surrounding a portion in the direction of the axis of center of rotation L of the grinding element bundles 11 from the outer peripheral side, and a connection part 34 connecting the shaft 32 with the annular part 33.

The shaft 32 is made of resin or metal. In the first embodiment, the shaft 32 is made of metal. When the shaft 32 is made of resin, the shaft 32 is formed of, for example, FRP resin to ensure its strength. As shown in FIG. 2, the shaft 32 is shaped like a cylinder and its upper portion is the shank portion 31. At the lower portion of the shaft 32, flat surfaces 35 are formed by cutting away a circumferential portion of the outer peripheral surface of the shaft 32 in parallel with the axis of center of rotation L. Three flat surfaces 35 are provided at regular angular intervals.

The annular part 33 and the connection part 34 are made of resin. In the first embodiment, the annular part 33 and the connection part 34 are made of ASB resin. The connection part 34 includes an annular portion 37 having a shaft hole 36, three arm portions 38 extending radially outward in the radius direction from the outer peripheral surface of the annular portion 37, and curved plate portions 39 each extending downward in the direction of the axis of center of rotation L from the end portion on the outer peripheral side of each of the arm portions 38. The annular portion 37 and three arm portions 38 in the connection part 34 are integrally formed, and the curved plate portions 39 are separate. The curved plate portions 39 are formed integrally with the annular part 33.

At the circumferentially central portion of the upper surface of each of the arm portions 38, a groove 40 is provided to extend in the radius direction. The groove 40 reaches from the end of each of the arm portions 38 on the outer peripheral side to the outer peripheral surface of the annular portion 37. As a result, parts of the outer peripheral surface of the annular portion 37 are exposed outward through the grooves 40. At the portions on the outer peripheral surface of the annular portion 37 exposed outward through the grooves 40, screw holes 41 are formed to pass through the annular portion 37 in the radius direction. The end surface of each of the arm portions 38 on the outer peripheral side has screw holes 42 recessed in the radius direction.

Figure 4:
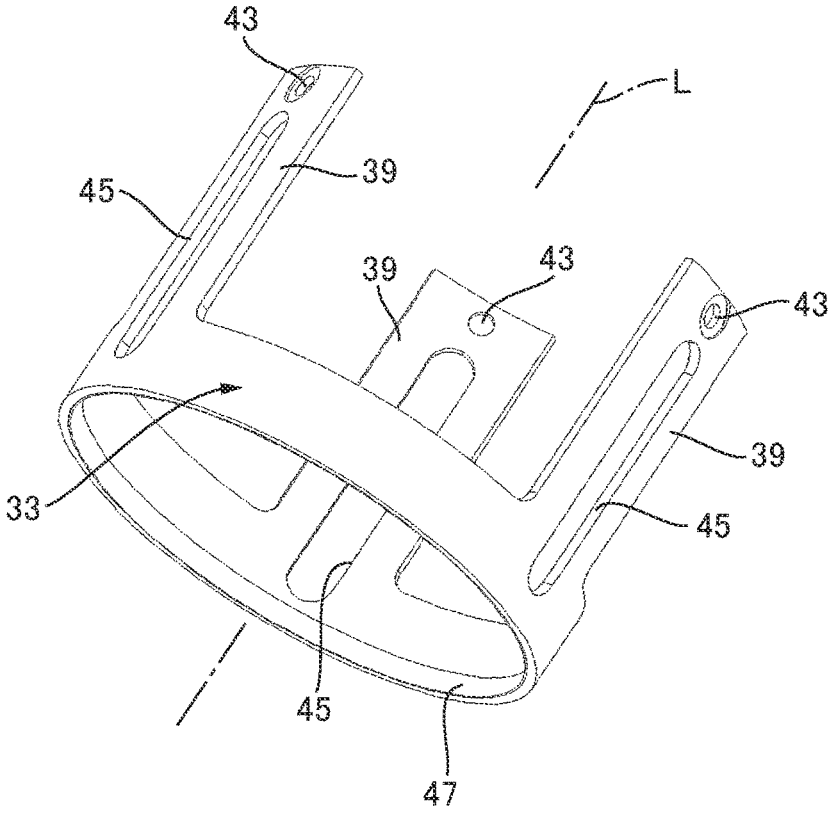
FIG. 4 is a perspective view of an annular part and curved plate portions.

As shown in FIG. 4, each of the curved plate portions 39 extends with a certain width upward from a circumferential portion of the annular part 33. The curved plate portions 39 are curved in the circumferential direction along the annular part 33. The upper end portions of the curved plate portions 39 have through holes 43. The curved plate portions 39 are removably coupled to the arm portions 38 with head screws 44 (see FIG. 1) passing through the through holes 43 to be screwed into the screw holes 42 in each of the arm portions 38. Below the through holes 43 in the curved plate portions 39, guide holes 45 are provided, which are formed in the shape of grooves along the direction of the axis of center of rotation L. Each of the guide holes 45 has its lower end portion reaching a midway position in the direction of the axis of center of rotation L in the annular part 33.

Here, as shown in FIG. 2, in the annular part 33, the height dimension h1 is constant where the curved plate portions 39 are not continuous upward. This height dimension h1 is equal to or smaller than ½ of the protruding length of the unused grinding element bundles 11 protruding downward from the grinding element holder 15.

A metal covering member 47 is attached to the grinding element displacement-restricting member 13. As shown in FIG. 4, the covering member 47 is annular and covers the end portions on the tip end side of the wire-shaped grinding elements 27 on the inner peripheral surface of the annular part 33. In the first embodiment, the covering member 47 is a metal adhesive tape. Alternatively, the covering member 47 may be a metal ring.

To assemble the grinding element displacement-restricting member 13, the arm portions 38 of the connection part 34 are coupled to the curved plate portions 39 with head screws 44 to integrate the annular part 33 and the connection part 34. The shaft 32 is passed through the shaft hole 36 in the annular portion 37 of the connection part 34, and the connection part 34 is fixed to the shaft 32 with head screws 48 (see FIG. 1) screwed in the screw holes 41 in the annular portion 37. Here, when the grinding element displacement-restricting member 13 is assembled, the grinding element displacement-restricting member 13 has three large openings 50 each defined by an arc portion 33*a* not connected with the connection part 34 (curved plate portions 39) in the annular part 33, two curved plate portions 39 adjacent to each other in the circumferential direction, the arm portions 38 extending toward the inner peripheral side from the two curved plate portions 39, and the annular portion 37.

To assemble the polishing brush 1, the brush-shaped grindstone 12 is attached to the grinding element displacement-restricting member 13. More specifically, as shown in FIG. 2, the grinding element displacement-restricting member 13 and the brush-shaped grindstone 12 are disposed concentrically, and the shaft 32 of the grinding element displacement-restricting member 13 is inserted into the holder-side shaft hole 16 of the brush-shaped grindstone 12. The grinding element holder 15 and the grinding element bundles 11 are thus disposed on the inner peripheral side of the annular part 33.

In addition, while the position of the brush-shaped grindstone 12 is adjusted in the direction of the axis of center of rotation L, the setscrews 14 are inserted into the holder-side through holes 22 of the grinding element holder 15 through the guide holes 45, so that the grinding element holder 15 is fixed to the shaft 32 of the grinding element displacement-restricting member 13 with the setscrews 14. As shown in FIG. 1, in a state in which the brush-shaped grindstone 12 is attached to the grinding element displacement-restricting member 13, the annular part 33 surrounds the grinding element bundles 11 (the wire-shaped grinding elements 27) from the outer peripheral side at a position between the tip ends of the grinding element bundles 11 (the tip ends of the wire-shaped grinding elements 27) and the grinding element holder 15 in the direction of the axis of center of rotation L and at a distance away from the tip ends of the grinding element bundles 11 (the tip ends of the wire-shaped grinding elements 27) and the grinding element holder 15.

Here, the setscrews 14 are inserted in the holder-side through holes 22 of the grinding element holder 15 through the guide holes 45, whereby the grinding element holder 15 is positioned in the circumferential direction relative to the grinding element displacement-restricting member 13. Thus, the flat surfaces 35 on the shaft 32 and the holder-side through holes 22 of the grinding element holder 15 are disposed at the overlapping positions as viewed in the radius direction. The tip ends of the setscrews 14 are screwed in the holder-side through holes 22, and therefore, abut on the flat surfaces 35 of the shaft 32.

When the grinding element holder 15 is positioned in the circumferential direction relative to the grinding element displacement-restricting member 13, the three holder-side arm portions 21 of the grinding element holder 15 overlap the three arm portions 38 of the grinding element displacement-restricting member 13 as viewed from the direction of the axis of center of rotation L. Therefore, as shown in FIG. 1, the polishing brush 1 has a space continuous to an interior space 55 on the inside of the grinding element bundles 11 arranged annularly from the direction of the axis of center of rotation L, through the openings 50 in the grinding element displacement-restricting member 13 and the holder-side openings 25 of the grinding element holder 15. Since the annular part 33 is kept apart from the grinding element holder 15 in the direction of the axis of center of rotation L, the portions on the side closer to the grinding element holder 15 of the grinding element bundles 11 held in the grinding element holder 15 are exposed outward, and the polishing brush 1 has a space continuous to the interior space 55 through the openings 50 of the grinding element displacement-restricting member 13 and between the adjacent grinding element bundles 11.

(Work Operation)

When burring or grinding/polishing work is performed on a surface of a workpiece using the polishing brush 1, the shank portion 31 is coupled to the head of a machine tool and rotated around the axis of center of rotation L, and the tip ends (the ends on the outer peripheral side) of the grinding element bundles 11 (the wire-shaped grinding elements 27) are pressed against the surface of the workpiece.

Here, the rotation of the polishing brush 1 allows the wire-shaped grinding elements 27 of each of the grinding element bundles 11 to spread outward. However, the tip end portions of the wire-shaped grinding elements 27 come into abutment with the annular part 33, which restricts the displacement of the wire-shaped grinding elements 27 outward. The wire-shaped grinding elements 27 of each of the grinding element bundles 11 therefore can be accurately pressed against the polished position of the workpiece. In addition, the contact position of the wire-shaped grinding elements 27 on the workpiece can be stabilized.

During work operation, cutting fluid or air is supplied from above the polishing brush 1 or from the outer peripheral side to cool the polished portion of the workpiece. The supplied cutting fluid or air removes chips.

Here, the portions on the side closer to the grinding element holder 15 of the grinding element bundles 11 of the polishing brush 1 are exposed outward. The polishing brush 1 has a space continuous from the openings 50 of the grinding element displacement-restricting member 13 to the interior space 55 surrounded by the grinding element bundles 11 through the holder-side openings 25 of the grinding element holder 15. The polishing brush 1 also has a space continuous to the interior space 55 surrounded by the grinding element bundles 11 through the openings 50 of the grinding element displacement-restricting member 13 and between the adjacent grinding element bundles 11. Therefore, when cutting fluid or air is supplied from above the polishing brush 1 or from the outer peripheral side, the cutting fluid or air can reach the polished portion of the workpiece. This enables cooling of the polished portion of the workpiece and also enables removable of chips.

When the wire-shaped grinding elements 27 are worn out due to work operation and the protruding length of the wire-shaped grinding elements 27 from the opening end **33*b* of the annular part 33 of the grinding element displacement-restricting member 13 is reduced, the position of the brush-shaped grindstone 12 fixed to the shaft 32 is adjusted in the direction of the axis of center of rotation L, whereby the protruding length of the wire-shaped grinding elements 27 from the opening end 33*b* is adjusted. To perform such adjustment operation, the setscrews 14 are loosened, and then the brush-shaped grindstone 12 is moved in the direction of the axis of center of rotation L on the inside of the annular part 33. The setscrews 14 are then tightened again. Here, when the brush-shaped grindstone 12 is moved in the direction of the axis of center of rotation L, the outer peripheral side-portions of the loosened setscrews 14 move inside the guide holes 45 along the guide holes 45 to allow the brush-shaped grindstone 12** to move in the direction of the axis of center of rotation L in such a state as to be positioned in the circumferential direction.

In the first embodiment, since the annular part 33 and the connection part 34 of the grinding element displacement-restricting member 13 are made of resin, the weight of the polishing brush 1 can be reduced compared with when they are made of metal. In addition, since the grinding element displacement-restricting member 13 has the three openings 50 in the circumferential direction, the weight of the polishing brush 1 can be reduced. This leads to reduction of power load of the machine tool to which the polishing brush 1 is attached. Moreover, since the grinding element displacement-restricting member 13 has the three openings 50 in the circumferential direction, the amount of resin used for producing the grinding element displacement-restricting member 13 can be reduced compared with when it does not have the openings 50. This can suppress the production cost for the grinding element displacement-restricting member 13.

Here, if the annular part 33 of the grinding element displacement-restricting member 13 is made of resin, the tip end portions of the wire-shaped grinding elements 27 spreading outward due to centrifugal force wear the annular part 33 when coming into contact with the annular part 33. By contrast, in the first embodiment, the metal covering member 47 covers the inner peripheral surface of the annular part 33 and thus prevents the wear of the annular part 33. In the first embodiment, since the annular part 33 is detachable from the polishing brush 1 together with the curved plate portions 39 of the connection part 34, the annular part 33 and the curved plate portions 39 can be replaced with new ones, for example, when the covering member 47 and the annular part 33 are worn out.

(Modification of Grinding Element Displacement-Restricting Member)

Figure 5:
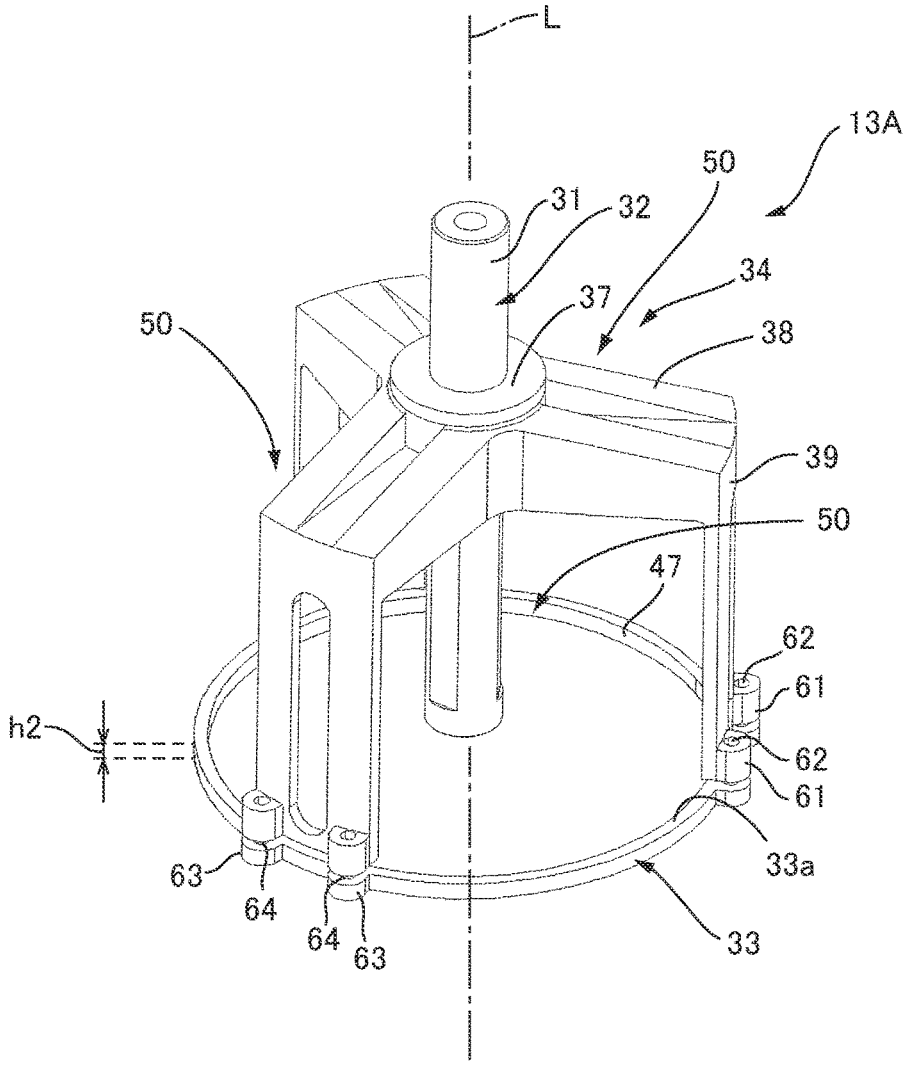
FIG. 5 is a perspective view of a grinding element displacement-restricting member in a modification.

FIG. 5 is a perspective view of a grinding element displacement-restricting member 13A in a modification. The grinding element displacement-restricting member 13A in the modification can be used in the same manner as the grinding element displacement-restricting member 13 of the polishing brush 1 in the first embodiment. The grinding element displacement-restricting member 13A in the modification has a configuration corresponding to the grinding element displacement-restricting member 13 of the polishing brush 1 in the first embodiment, and the corresponding parts are denoted with the same reference signs and will not be further elaborated.

In the modification, the connection part 34 includes an annular portion 37, arm portions 38, and curved plate portions 39, which are integrally formed. The annular part 33 is removably connected to the lower end portions of the curved plate portions 39. More specifically, at the lower edge of each of the curved plate portions 39, projections 61 protruding outward are provided at two places kept apart in the circumferential direction. Each of the projections 61 has a screw hole 62 passing through in the direction of the axis of center of rotation L. The annular part 33 has a constant height dimension h2 and has projections 63 protruding outward at positions corresponding to the projections 61 of each of the curved plate portions 39. Each of the projections 63 has a through hole 64 passing through in the axis of center of rotation L. The annular part 33 is removably fixed to the connection part 34 with head screws (not shown), which pass through the through holes 64 from below to be screwed in the screw hole 62 of the projection 61 of the connection part 34.

When the grinding element displacement-restricting member 13A is assembled, the grinding element displacement-restricting member 13A has three large openings 50 each defined by an arc portion 33*a* not connected with the connection part 34 (curved plate portions 39) in the annular part 33, two curved plate portions 39 adjacent to each other in the circumferential direction, the arm portions 38 extending toward the inner peripheral side from the two curved plate portions 39, and the annular portion 37.

Here, the height dimension h2 of the annular part 33 is equal to or smaller than ¼ of the protruding length of the unused grinding element bundles 11 protruding downward from the grinding element holder 15. On the inner peripheral surface of the annular part 33, a metal covering member 47 is attached to cover the entire inner peripheral surface.

The polishing brush 1 having the grinding element displacement-restricting member 13A in the modification also exerts the similar operation effects as in the polishing brush 1 in the first embodiment.

In the modification, the annular part 33 may be made of metal and the covering member 47 may be eliminated. That is, in the modification, the annular part 33 is a relatively small member and the annular part 33 is solely removable from the connection part 34. Therefore, even when the annular part 33 is made of metal, an increase in weight of the polishing brush 1 can be suppressed, and the cost for replacement of the annular part 33 can be suppressed.

Here, the grinding element displacement-restricting member 13 and the grinding element displacement-restricting member 13A have the guide holes 45 extending in the direction of the center axis of rotation. The guide holes 45, however, may be eliminated. In this case, setscrews 14 are screwed into the holder-side through holes 22 through the openings 50 of the grinding element displacement-restricting member 13A, so that the brush-shaped grindstone 12 is fixed to the shaft 32 of the grinding element displacement-restricting member 13A.

Second Embodiment

Figure 6:
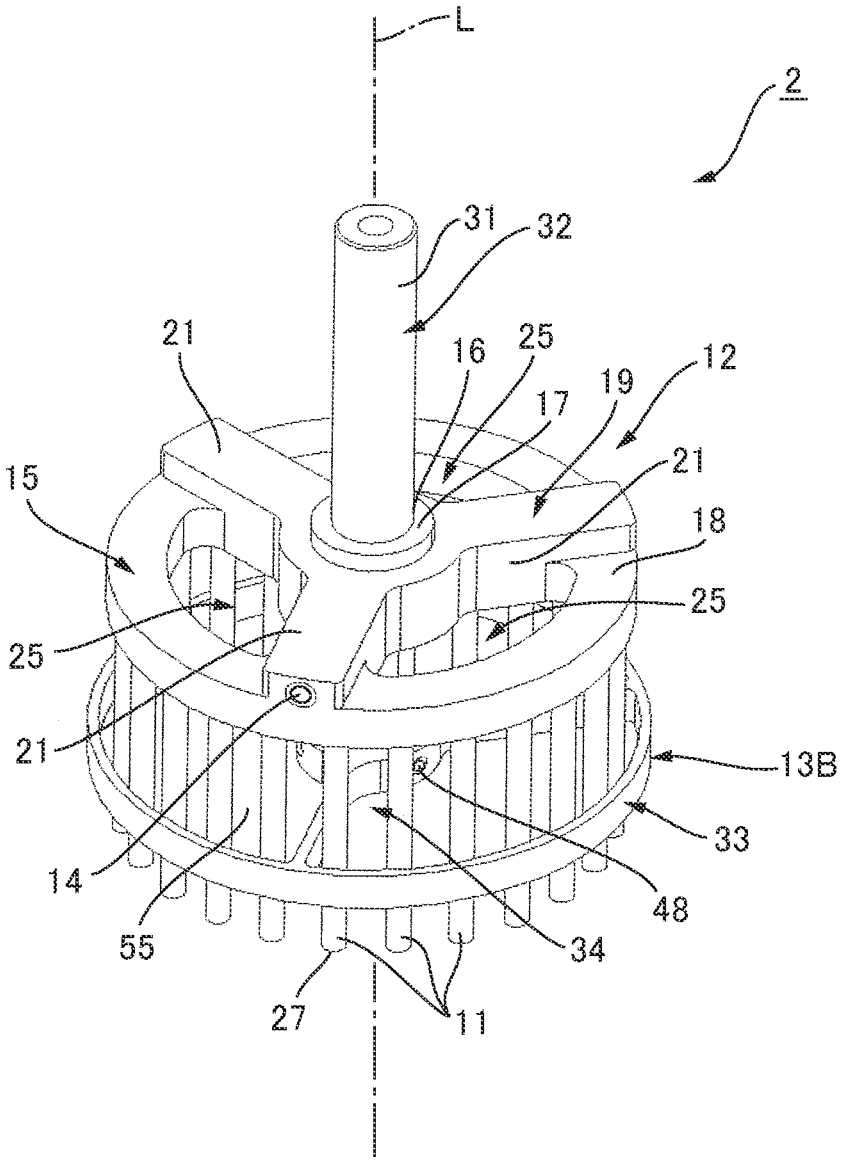
FIG. 6 is a perspective view of a polishing brush according to a second embodiment of the present invention.
Figure 7:
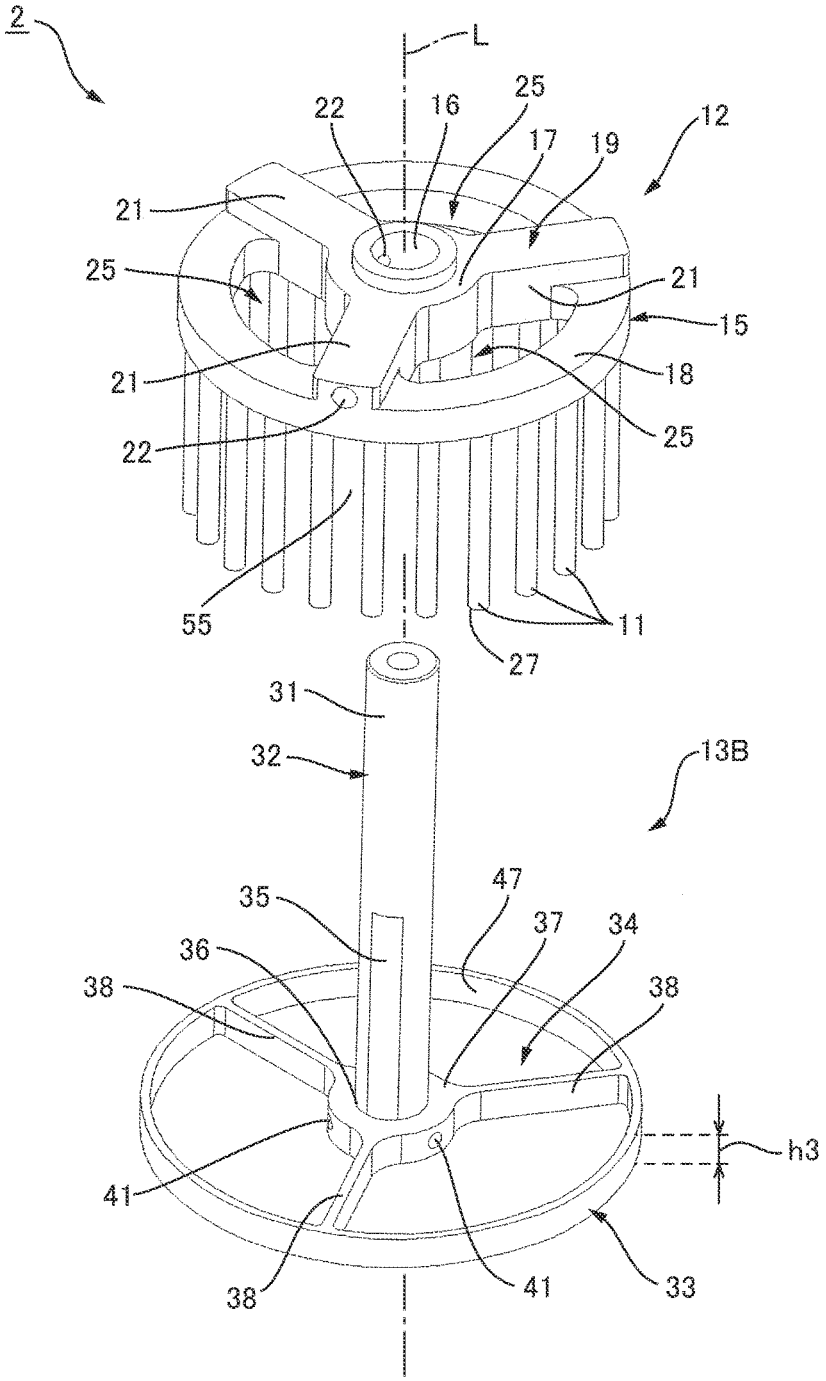
FIG. 7 is an exploded perspective view of the polishing brush in FIG. 6.

FIG. 6 is a perspective view of a polishing brush 2 in a second embodiment of the present invention. FIG. 7 is an exploded perspective view of the polishing brush 2 in FIG. 6. As shown in FIG. 6, the polishing brush 2 in the second embodiment includes a brush-shaped grindstone 12 having a plurality of grinding element bundles 11 arranged annularly, and a grinding element displacement-restricting member 13B for restricting displacement of the grinding element bundles 11 outward. The brush-shaped grindstone 12 is removably attached to the grinding element displacement-restricting member 13B with setscrews 14. The brush-shaped grindstone 12 of the polishing brush 2 in the second embodiment is identical with the brush-shaped grindstone 12 of the polishing brush 2 in the first embodiment. The polishing brush 2 in the second embodiment has a configuration corresponding to the polishing brush 1 in the first embodiment, and the corresponding parts are denoted with the same reference signs and will not be further elaborated.

(Grinding Element Displacement-Restricting Member)

As shown in FIG. 6, the grinding element displacement-restricting member 13B includes a shaft 32 having a shank portion 31 coupled to the head of a machine tool (drive device), an annular part 33 surrounding the portions in the direction of the axis of center of rotation L of the grinding element bundles 11 from the outer peripheral side, and a connection part 34 connecting the shaft 32 with the annular part 33.

The shaft 32 is shaped like a cylinder and its upper portion is the shank portion 31. As shown in FIG. 7, flat surfaces 35 are formed at the lower portion of the shaft 32. Three flat surfaces 35 are provided at regular angular intervals.

The annular part 33 and the connection part 34 are made of resin. In the second embodiment, the annular part 33 and the connection part 34 are integrally formed. The connection part 34 includes an annular portion 37 having a shaft hole 36 and three arm portions 38 extending radially outward in the radius direction from the outer peripheral surface of the annular portion 37. The ends on the outer peripheral side of three arm portions 38 are continuous to the inner peripheral surface of the annular part 33, whereby the arm portions 38 connect a circumferential portion of the annular portion 37 with a circumferential portion of the annular part 33. The thickness dimension in the circumferential direction of the arm portion 38 is smaller than the distance between the adjacent grinding element bundles 11 held annularly in the grinding element holder 15. At a portion on the outer peripheral surface of the annular portion 37 between two adjacent arm portions 38, a screw hole 41 is formed to pass through the annular portion 37 in the radius direction.

Here, as shown in FIG. 7, the annular part 33 and the connection part 34 have the identical height dimension h3. That is, the height dimension h3 of the annular portion 37 and the arm portion 38 of the connection part 34 is identical with the height dimension h3 of the annular part 33. The height dimension h3 of the annular part 33 is equal to or smaller than ¼ of the protruding length of the unused grinding element bundles 11 protruding downward from the grinding element holder 15. On the inner peripheral surface of the annular part 33, a metal covering member 47 is attached to cover the entire inner peripheral surface.

To assemble the grinding element displacement-restricting member 13B, the shaft 32 is passed through the shaft hole 36 disposed in the annular portion 37 of the connection part 34, and the connection part 34 and the annular part 33 are fixed to the shaft 32 with head screws 48 (see FIG. 6) screwed in the screw holes 41 of the annular portion 37. The connection part 34 and the annular part 33 are fixed at a position where the lower end of the annular part 33 coincides with the lower end of the shaft 32.

To assemble the polishing brush 2, the brush-shaped grindstone 12 is attached to the grinding element displacement-restricting member 13B. More specifically, as shown in FIG. 7, the grinding element displacement-restricting member 13B and the brush-shaped grindstone 12 are disposed concentrically, and the shaft 32 of the grinding element displacement-restricting member 13B is inserted into the holder-side shaft hole 16 of the brush-shaped grindstone 12. The arm portion 38 of the connection part 34 of the grinding element displacement-restricting member 13B is inserted between the grinding element bundles 11 held at regular angular intervals in the brush holder. The grinding element holder 15 and the grinding element bundles 11 are thus disposed on the inner peripheral side of the annular part 33.

In addition, while the position of the brush-shaped grindstone 12 is adjusted in the direction of the axis of center of rotation L, the setscrews 14 are inserted into the holder-side through holes 22 of the grinding element holder 15, so that the grinding element holder 15 is fixed to the shaft 32 of the grinding element displacement-restricting member 13B with the setscrews 14. Here, in a state in which the brush-shaped grindstone 12 is attached to the grinding element displacement-restricting member 13B, as shown in FIG. 6, the annular part 33 surrounds the grinding element bundles 11 (the wire-shaped grinding elements 27) from the outer peripheral side at a position between the tip ends of the grinding element bundles 11 (the tip ends of the wire-shaped grinding elements 27) and the grinding element holder 15 in the direction of the axis of center of rotation L and at a distance away from the tip ends of the grinding element bundles 11 (the tip ends of the wire-shaped grinding elements 27) and the grinding element holder 15.

(Work Operation)

When burring or grinding/polishing work is performed on a surface of a workpiece using the polishing brush 2, the shank portion 31 is coupled to the head of a machine tool and rotated around the axis of center of rotation L, and the tip ends (the ends on the outer peripheral side) of the grinding element bundles 11 (wire-shaped grinding elements 27) are pressed against the surface of the workpiece.

Here, the rotation of the polishing brush 2 allows the wire-shaped grinding elements 27 of each of the grinding element bundles 11 to spread outward. However, the tip end portions of the wire-shaped grinding elements 27 come into abutment with the annular part 33, which restricts the displacement of the wire-shaped grinding elements 27 outward. The wire-shaped grinding elements 27 of each of the grinding element bundles 11 therefore can be accurately pressed against the polished position of the workpiece. In addition, the contact position of the wire-shaped grinding elements 27 on the workpiece can be stabilized.

During work operation, cutting fluid or air is supplied from above the polishing brush 2 or from the outer peripheral side to cool the polished portion of the workpiece. The supplied cutting fluid or air removes chips.

Here, the grinding element bundles 11 of the polishing brush 2 are merely surrounded by the annular part 33 at a position between the tip ends of the grinding element bundles 11 (the tip ends of the wire-shaped grinding elements 27) and the grinding element holder 15 in the direction of the axis of center of rotation L and at a distance away from the tip ends of the grinding element bundles 11 (the tip ends of the wire-shaped grinding elements 27) and the grinding element holder 15. The grinding element holder 15 has holder-side openings 25 in communication with an interior space 55 surrounded by a plurality of grinding element bundles 11 between the first annular part 17 and the second annular part 18. Therefore, when cutting fluid or air is supplied from above the polishing brush 2 or from the outer peripheral side, the cutting fluid or air can reach the polished portion of the workpiece. This enables cooling of the polished portion of the workpiece and also enables removable of chips.

The polishing brush 2 having the grinding element displacement-restricting member 13B in the second embodiment also exerts the similar operation effects as in the polishing brush 2 in the first embodiment.

In the second embodiment, the annular part 33 and the connection part 34 may be made of metal. That is, in the second embodiment, the annular part 33 and the connection part 34 are formed integrally, and the annular part 33 is a relatively small member. Therefore, even when the annular part 33 and the connection part 34 are made of metal, an increase in weight of the polishing brush 2 can be suppressed, and the cost for replacement of the annular part 33 can be suppressed.

Other Embodiments

In the foregoing embodiments, each of the wire-shaped grinding elements 27 includes an assembly of inorganic filaments. Alternatively, the wire-shaped grinding element 27 may be formed of nylon, abrasive-containing nylon, abrasive-containing rubber, stainless steel, or brass.

The covering member 47 may be eliminated. Here, when the covering member 47 is eliminated, the lower end portion (the portion on the tip end side of each of the wire-shaped grinding elements 27) of the annular part 33 may be formed of a resin that has higher abrasion resistance and lower friction coefficient compared with other parts.

In the foregoing embodiments, the wire-shaped grinding elements 27 are subdivided and bundled into each of the grinding element bundles 11, and the grinding element bundles 11 are arranged annularly to be kept apart from each other. Alternatively, the wire-shaped grinding elements 27 may not be formed into a bundle but may be held annularly in the grinding element holder 15. Even in the polishing brush 2 with this configuration, at least the portions closer to the grinding element holder 15 of the wire-shaped grinding elements 27 are exposed outward. Therefore, when cutting fluid or air is supplied from above the polishing brush 2 or from the outer peripheral side, the cutting fluid or air can reach the polished portion of the workpiece. This enables cooling of the polished portion of the workpiece and also enables removable of chips.

The invention claimed is:

1. A polishing brush comprising:

a grinding element holder;

a plurality of wire-shaped grinding elements protruding from the grinding element holder in a direction of an axis of center of rotation, wherein the rotation of the polishing brush allows the wire-shaped grinding elements to spread outward; and a grinding element displacement-restricting member, which restricts displacement of the wire-shaped grinding elements outward when the polishing brush is rotated, having:

an outside annular part surrounding the wire-shaped grinding elements from an outer peripheral side at a position between tip ends of the wire-shaped grinding elements and the grinding element holder in the direction of the axis of center of rotation and at a distance away from the tip ends of the wire-shaped grinding elements and the grinding element holder;

a shaft, which extends in the direction of the axis of center of rotation on the inner peripheral side of the outside annular part; and a connection part, which connects the shaft with the outside annular part, wherein the grinding element holder has a shaft hole which passes in the direction of the axis of center of rotation, and holder-side openings which are formed outside the shaft hole in the grinding holder and passes in the direction of the axis of center of rotation, the shaft of the grinding element displacement-restricting member is inserted in the shaft hole of the grinding element holder so that the grinding element holder is removably fixed to the grinding element displacement-restricting member, the connection part connects the shaft with part of a circumferential portion of the outside annular part, and wherein the grinding element holder includes:

a first annular part having the shaft hole;

a second annular part having an inner diameter size larger than the first annular part and disposed at a distance away from the outer peripheral side of the first annular part; and a plurality of holder-side connection parts connecting a circumferential portion of the first annular part with a circumferential portion of the second annular part, each of the holder-side openings is arranged between the first annular part and the second annular part and between the adjacent two holder-side arm portions, the wire-shaped grinding elements are held in the second annular part and are disposed annularly around the axis of center of rotation, and when viewed from the direction of the axis of center of rotation, the holder-side connection part coincides with the connection part of the grinding element displacement-restricting member.

2. The polishing brush according to claim 1, wherein the outside annular part is removably attached to the connection part.

3. The polishing brush according to claim 1, wherein the outside annular part and the connection part are integrally formed, and the connection part is removably attached to the shaft.

4. The polishing brush according to claim 1, wherein the connection part includes:

an annular part-side connection portion extending continuously from the outside annular part; and a shaft-side connection portion connecting the annular part-side connection portion with the shaft, and the annular part-side connection portion and the shaft-side connection portion are removably connected.

5. The polishing brush according to claim 1, wherein the wire-shaped grinding elements are subdivided and bundled into a plurality of grinding element bundles, and the grinding element bundles are arranged annularly to be kept apart from each other and are held on an outer peripheral side of the holder-side openings, by the grinding element holder.

6. The polishing brush according to claim 1, wherein a metal covering member covers end portions on the tip end side of the wire-shaped grinding elements on an inner peripheral surface of the outside annular part, and at least the outside annular part of the grinding element displacement-restricting member is made of resin.

* * * * *